US010030472B2

(12) United States Patent
Fripp

(10) Patent No.: US 10,030,472 B2
(45) Date of Patent: Jul. 24, 2018

(54) FRANGIBLE PLUG TO CONTROL FLOW THROUGH A COMPLETION

(71) Applicant: HALLIBURTON ENERGY SERVICES, INC., Houston, TX (US)

(72) Inventor: Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 458 days.

(21) Appl. No.: 14/435,975

(22) PCT Filed: Feb. 25, 2014

(86) PCT No.: PCT/US2014/018188

§ 371 (c)(1),
(2) Date: Apr. 15, 2015

(87) PCT Pub. No.: WO2015/130258

PCT Pub. Date: Sep. 3, 2015

(65) Prior Publication Data

US 2016/0251937 A1 Sep. 1, 2016

(51) Int. Cl.

| | |
|---|---|
| ***E21B 34/06*** | (2006.01) |
| ***E21B 34/12*** | (2006.01) |
| ***E21B 43/12*** | (2006.01) |
| *E21B 34/00* | (2006.01) |

(52) U.S. Cl.
CPC ..... *E21B 34/063* (2013.01); *E21B 43/12* (2013.01); *E21B 2034/007* (2013.01)

(58) Field of Classification Search
CPC ..... E21B 43/12; E21B 34/063; E21B 34/08; E21B 2034/007
See application file for complete search history.

(56) References Cited

U.S. PATENT DOCUMENTS

| | | | |
|---|---|---|---|
| 1,854,477 | A | 4/1932 | McKissick |
| 2,070,907 | A | 2/1937 | Laughinghouse |
| 2,903,074 | A | 9/1959 | Layton et al. |
| 2,913,051 | A | 11/1959 | Lister |
| 2,922,479 | A | 1/1960 | Kinley |
| 3,095,040 | A | 6/1963 | Bramlett |

(Continued)

FOREIGN PATENT DOCUMENTS

| | | |
|---|---|---|
| EP | 681087 | 7/1997 |
| WO | 2012174662 | 12/2012 |

OTHER PUBLICATIONS

International Patent Application No. PCT/US2014/018188 , International Search Report and Written Opinion, dated Nov. 28, 2014, 13 pages.

*Primary Examiner* — Jennifer H Gay

(74) *Attorney, Agent, or Firm* — Kilpatrick Townsend & Stockton LLP

(57) ABSTRACT

A tubing string can include a plug blocking fluid flow through a port. The plug can be a frangible component or include a frangible component. When the frangible component is broken, fluid is allowed to flow through the port. An object is releasable from downwell and breaks the frangible component as the object travels towards the surface of the well, propelled by the production fluid. Fluid flow through the port can cause a sleeve to open or close additional ports. Fluid flow through the port can allow for optimized production from the wellbore.

20 Claims, 18 Drawing Sheets

(56) References Cited

U.S. PATENT DOCUMENTS 3,333,635 A 7/1967 Crawford
3,645,335 A 2/1972 Current
3,661,207 A 5/1972 Current et al.
4,260,017 A 4/1981 Nelson et al.
4,577,702 A 3/1986 Faulkner et al.
4,603,741 A 8/1986 Edgmon et al.
4,673,039 A * 6/1987 Mohaupt ..... E21B 43/263 166/281
5,464,062 A * 11/1995 Blizzard, Jr. ..... E21B 33/127 166/100
6,095,247 A * 8/2000 Streich ..... E21B 17/00 166/296
6,220,357 B1 * 4/2001 Carmichael ..... E21B 34/10 166/227
7,762,342 B2 7/2010 Richard et al.
2010/0122813 A1 * 5/2010 Trummer ..... E21B 33/138 166/255.1
2011/0025877 A1 2/2011 Gallagher et al.
2012/0073827 A1 * 3/2012 Kenyon ..... E21B 34/14 166/373
2012/0111574 A1 5/2012 Desranleau et al.
2012/0118582 A1 * 5/2012 Soni ..... E21B 34/14 166/374
2013/0025877 A1 1/2013 Robinson-Brown et al.
2013/0105175 A1 5/2013 Mailand et al.
2013/0168090 A1 * 7/2013 Themig ..... E21B 34/14 166/285
2013/0312965 A1 * 11/2013 Themig ..... E21B 34/063 166/285
2014/0151052 A1 * 6/2014 Themig ..... E21B 34/063 166/308.1
2015/0013972 A1 * 1/2015 Al-Rabeh ..... E21B 34/063 166/250.12
2015/0337624 A1 * 11/2015 Themig ..... E21B 33/146 166/285
2015/0376985 A1 * 12/2015 Huggins ..... E21B 21/103 166/374
2016/0251937 A1 * 9/2016 Fripp ..... E21B 43/12 166/373

* cited by examiner

FRANGIBLE PLUG TO CONTROL FLOW THROUGH A COMPLETION

CROSS-REFERENCE TO RELATED APPLICATIONS

This is a U.S. national phase under 35 U.S.C. § 371 of International Patent Application No. PCT/US2014/018188, titled "Frangible Plug to Control Through a Completion" and filed Feb. 25, 2014, the entirety of which is hereby incorporated by reference herein.

TECHNICAL FIELD

The present disclosure relates generally to fluid flow through well completions.

BACKGROUND

In oilfield operations, completions can be used to optimize production from a well. To optimize production from a well, completions can include ports that allow production fluids to flow from the annulus to the inner diameter of the completion tubing. The ports can cause undesirable effects at other times, such as when the tubing is being placed in the well, during run-in, during wellbore cleanup, when placing packers, when placing gravel pack, and at other times when a solid piece of tubing is desirable, whether for structural-related, pressure-related, or other reasons. For example, during cleanup operations, the presence of ports in the completion can allow cleanup fluids to exit the completion before the cleanup fluids reach the toe of the wellbore, and can reduce the efficiency of the cleanup procedure. To avoid such problems, a washpipe can be used, which requires an additional trip in the well and has the potential to become stuck in the well. As another example, during placement of packers, ports can make the necessary buildup of pressure difficult.

DETAILED DESCRIPTION

Figure 1:
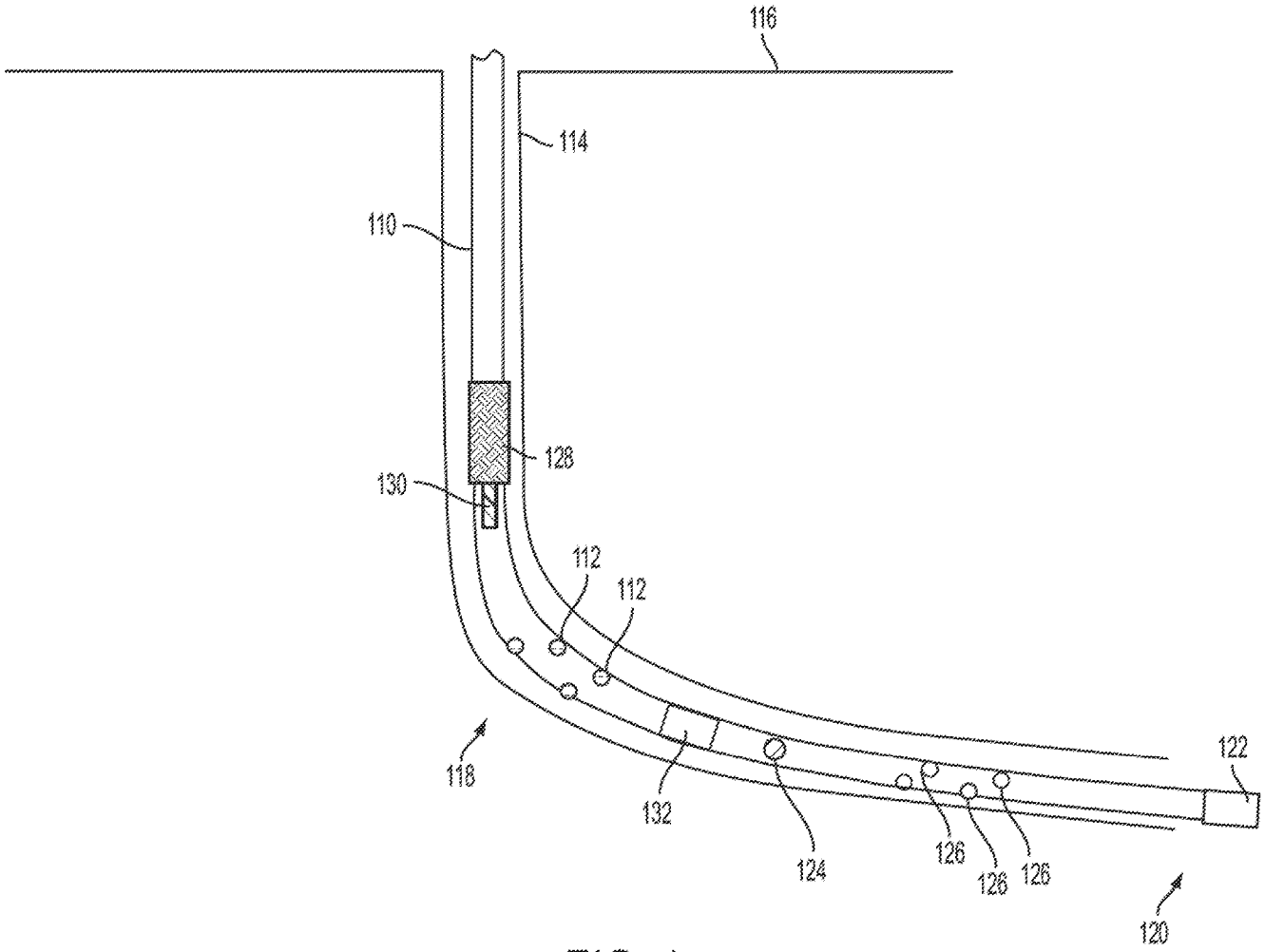
FIG. 1 is a cross-sectional view of a tubing string containing frangible components according to one embodiment of the present disclosure.

Certain embodiments and features relate to mechanically opening ports in a tubing string or tubing string. In one embodiment, frangible plugs are positioned within ports to block fluid flow through the ports. An object, such as a ball, is released from a pre-placed position downwell and allowed to travel towards the surface along with production fluid. As the ball passes the frangible plugs, the ball breaks the plugs to cause the ports to open to fluid flow.

According to one embodiment of the present disclosure, a tubing string, such as a tubing string used in wellbore completions, can include one or more ports that allow production fluids to flow from the annulus to the inner diameter of the tubing. As used herein, the term "port" can refer to any opening in the tubing string, regardless of shape or method of formation. In one embodiment, ports are occluded by a frangible cover or plug. The frangible covers can prevent fluid from flowing through the ports. During wellbore cleanup, for example, the frangible covers can prevent cleanup fluids from passing through the ports to help force the cleanup fluids to the toe of the wellbore. Subsequently, an object, such as a ball, can be released from downwell and allowed to travel towards the surface of the wellbore. The object can be carried by production fluid. The amount of energy or supplies used to propagate the object can be minimized. As the object reaches a port, the object can strike the frangible cover and cause the frangible cover to break. Once broken, the frangible cover no longer occludes the port. The open port allows fluid to pass through the tubing string (e.g., from the annulus through to the inner diameter of the tubing string).

The object and frangible cover can be made of a degradable material. The frangible cover can be made of a material that has a slower degradation rate than material from which the object is made. Examples of materials from which the object can be made include degradable polymers (such as Polyglycolide (PGA)), eutectic alloys, galvanic composition, aluminum, salt, compressed wood product, or other degradable materials. Examples of materials from which the frangible cover can be made include ceramic, aluminum, plastic (such as a thermoset plastic), casting, or other degradable materials.

In one embodiment, the frangible covers have different lengths at different zones of the wellbore such that different diameter objects can be used to break the frangible covers progressively at each zone. A small diameter object can be released downwell first and can break frangible covers near the toe of the wellbore. Subsequently, a larger diameter object can be released downwell and can break frangible covers in another zone, such as near the heel of the wellbore. An object can be released in various ways, such as electronically or with pressure cycling. An object can also be retained by a degradable material that releases the object after an amount of time. The amount of time before the degradable material releases the object can be estimated based on degradation rates.

Certain embodiments disclosed herein can allow ports on a completion to open without the use of electronics or sliding components. Ports can be allowed to open with reduced use of energy or resources. Control of multiple ports or devices can be allowed. Opening of the wellbore from the toe to the heel can be allowed. "Disappearing" balls or valve covers can be allowed, such as through the use of degradable materials.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a cross-sectional view of a tubing string 110 containing frangible components 112, according to one embodiment. As used herein, the term "tubing string" includes one or more tubing string components. A wellbore 114 is shown extending from a surface 116. The surface 116 can be above ground or underwater. The wellbore 114 includes a heel 118 and a toe 120. The tubing string 110 can include a release section 122 capable of retaining an object 124 until the object is ready to be released. The release section 122 can be lowered into the wellbore 114 with the object 124 included therein when the tubing string 110 is installed. In some embodiments, the release section 122 can be a lateral tubular attached to the tubing string 110.

Upon being released from the release section 122, the object 124 can travel upwell towards the surface 116. The object 124 can be carried along with production fluid. Because the object 124 can be carried along with the production fluid, the object 124 may be able to better traverse through non-vertical sections of the wellbore 114, at least because the object 124 does not rely on gravity to travel. Additionally, an object 124 propelled by production fluid may not require additional fluids to be injected into the wellbore 114 and may not require shutting down the wellbore 114 to break the frangible components 112. The object 124 can be a ball, a dart, a wiper, a plug, or another free-flowing device. The object can be made of a degradable material. In other embodiments, the object can be a metal, a composite metal, or other materials. The object can include density reducing features, such as glass microspheres or low-density constituents. The lower density can aid in the propagation of the object towards the surface.

As the object 124 travels within the wellbore 114, the object 124 can impact the frangible component 112 and cause the frangible component 112 to break, as described in further detail below. In an unbroken state, a frangible component 112 can occlude the port 126 to which the frangible component 112 is associated. When a frangible component 112 breaks, the broken frangible component 112 can cease to occlude the port 126, and fluid flow can be allowed through the port 126.

In some embodiments, a frangible component 112 is associated with a sleeve 128. The sleeve 128 can move (e.g., slide axially or rotationally) to cover or uncover one or more ports 126 associated with the sleeve 128. The sleeve 128 can move in response to movement of a piston in a piston chamber 130, as discussed in further detail below.

An object 124 can be released from the release section 122, and can travel up a tubing string 110 towards the surface 116. The object 124 can impact and break frangible components 112 in a first set of ports 126. The object 124 in FIG. 1 is not yet past frangible components 112, and ports 126 associated with the frangible components 112 remain occluded.

In some embodiments, a tubing string 110 can have a release section 132 located between the toe 120 of the wellbore 114 and the surface 116. In other embodiments, the tubing string 110 can include multiple release sections 122, 132. In some embodiments, a first object 124 can be released from a first release section 122 at a first time and a second object can be released from a second release section 132 at a different time to control the breakage of frangible components 112 within the wellbore 114.

Figure 2A:
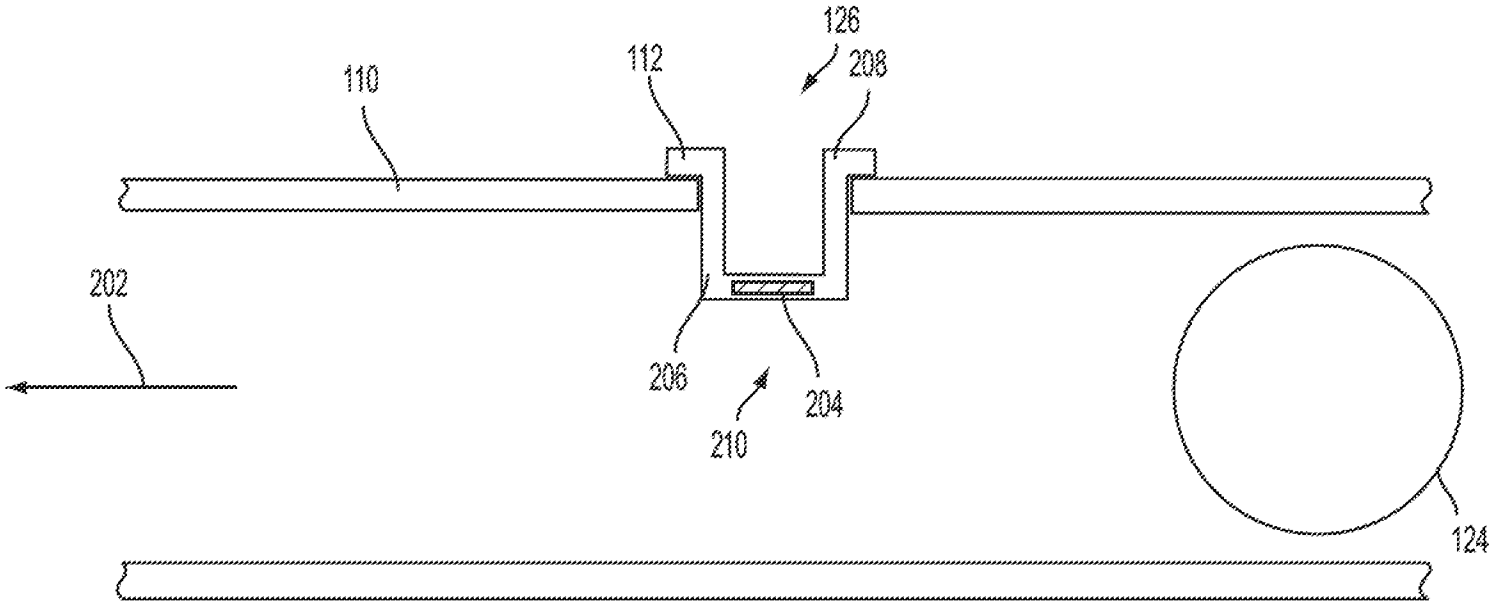
FIG. 2A is a cross-sectional view of part of a tubing string having a frangible component according to one embodiment of the present disclosure.

FIG. 2A is a cross-sectional view of part of a tubing string 110 having a frangible component 112, according to one embodiment. The frangible component 112 can be of various shapes and sizes. The frangible component 112 can be a plug 210 (e.g., a frangible plug) occluding a port 126. In another embodiment, the frangible component 112 can be a portion of a plug 210 occluding a port 126. The frangible component 112 blocks fluid flow through the port 126. The object 124 can be a ball. The object 124 can be moving in a direction 202 towards the surface 116 of the wellbore 114.

The port 126 can be occluded by a plug 210 having a retainable portion 208 and a detachable portion 206. The retainable portion 208 can be designed to remain within the port 126 after the detachable portion 206 breaks off and is carried away. Upon installation, the retainable portion 208 and detachable portion 206 can be adjoined or made of a single material. In some embodiments, entire plug 210 can be the frangible component 112, meaning the retainable portion 208 and detachable portion 206 are both the frangible component 112. In alternate embodiments, the plug 210 includes an area of frangible material, which is the frangible component 112. The area of frangible material can hold together the two parts of the plug 210 together, meaning the frangible component 112 adjoins the detachable portion 206 to the retainable portion 208. In alternate embodiments, the plug 210 can include a detachable portion 206 that is a frangible component 112, and a less brittle retainable portion 208. In an alternative embodiment, the plug 210 can include a stress riser within the frangible component 112 in order to aid the fracture.

In some embodiments, the plug 210 or frangible component 112 can include a magnet 204. The magnet 204 can be positioned within or on a surface of the detachable portion 206. As used herein, reference to the magnet 204 being "coupled to" the detachable portion 206 or frangible component 112 includes positioned within, positioned on, or otherwise attached to the respective detachable portion 206 or frangible component 112. When the frangible component 112 breaks, the magnet 204 can be carried away with the detachable portion 206. The magnet 204 can be used for various purposes, including to sense whether the frangible component 112 has broken. A magnetic sensor can be positioned near one or multiple frangible components 112 and can provide a signal indicating whether some or all of the nearby frangible components 112 have broken (i.e., the magnets 204 of respective frangible components 112 are no longer present).

In alternate embodiments, the magnet 204 is sufficiently strong to hold the detachable portion 206 against a ferromagnetic downwell structure (e.g., tubing string 110). The magnet 204 must be sufficiently strong to resist being carried away with production fluid flow. Use of strong magnets 204 can reduce the risk that numerous detachable portions 206 will collect together and block the tubing string 110 (e.g., block travel of the object 124 further upwell, towards the surface 116). Use of strong magnets 204 can also reduce the number of detachable portions 206 produced during well production.

In alternate embodiments, the detachable portion 206 does not include a magnet 204.

Figure 2B:
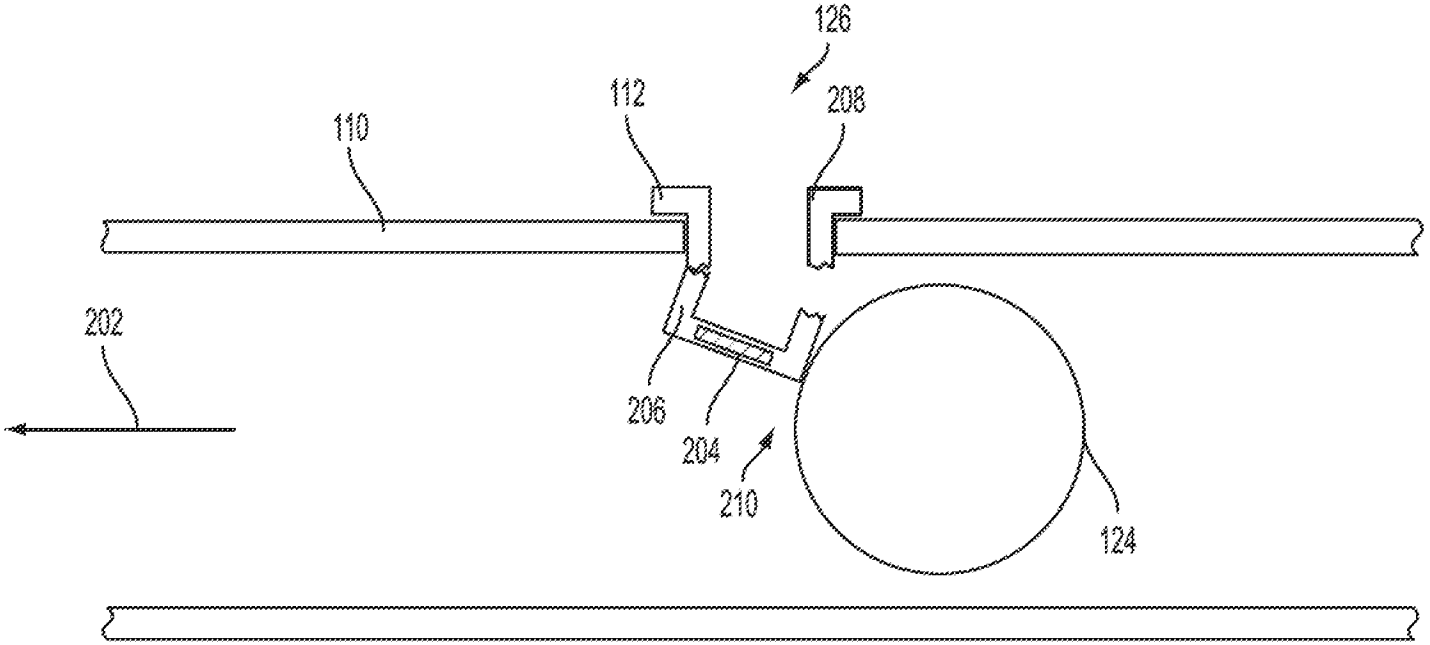
FIG. 2B is a cross-sectional view of part of the tubing string of FIG. 2A in which the frangible component is partially broken by an object according to one embodiment of the present disclosure.

FIG. 2B is a cross-sectional view of part of the tubing string 110 of FIG. 2A in which the frangible component 112 is partially broken by an object 124. Upon impact by the object 124, the frangible component 112 can break. The detachable portion 206 can partially break away from the retainable portion 208.

Figure 2C:
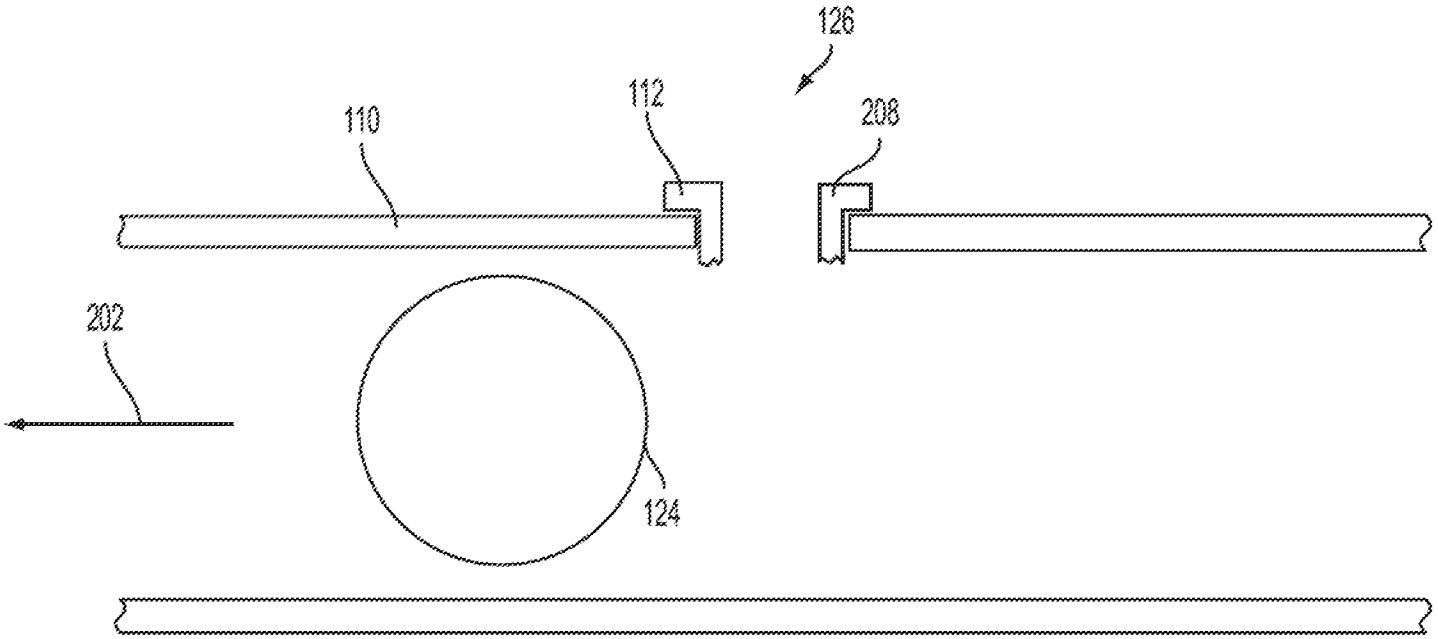
FIG. 2C is a cross-sectional view of part of the tubing string of FIG. 2A in which the frangible component is fully broken according to one embodiment of the present disclosure.

FIG. 2C is a cross-sectional view of part of the tubing string 110 of FIG. 2A in which the frangible component 112 is fully broken according to one embodiment. The detachable portion 206 can be carried away with the production fluid. The retainable portion 208 can remain in the port 126. The retainable portion 208 includes an opening to allow fluid flow through the port 126.

Figure 3A:
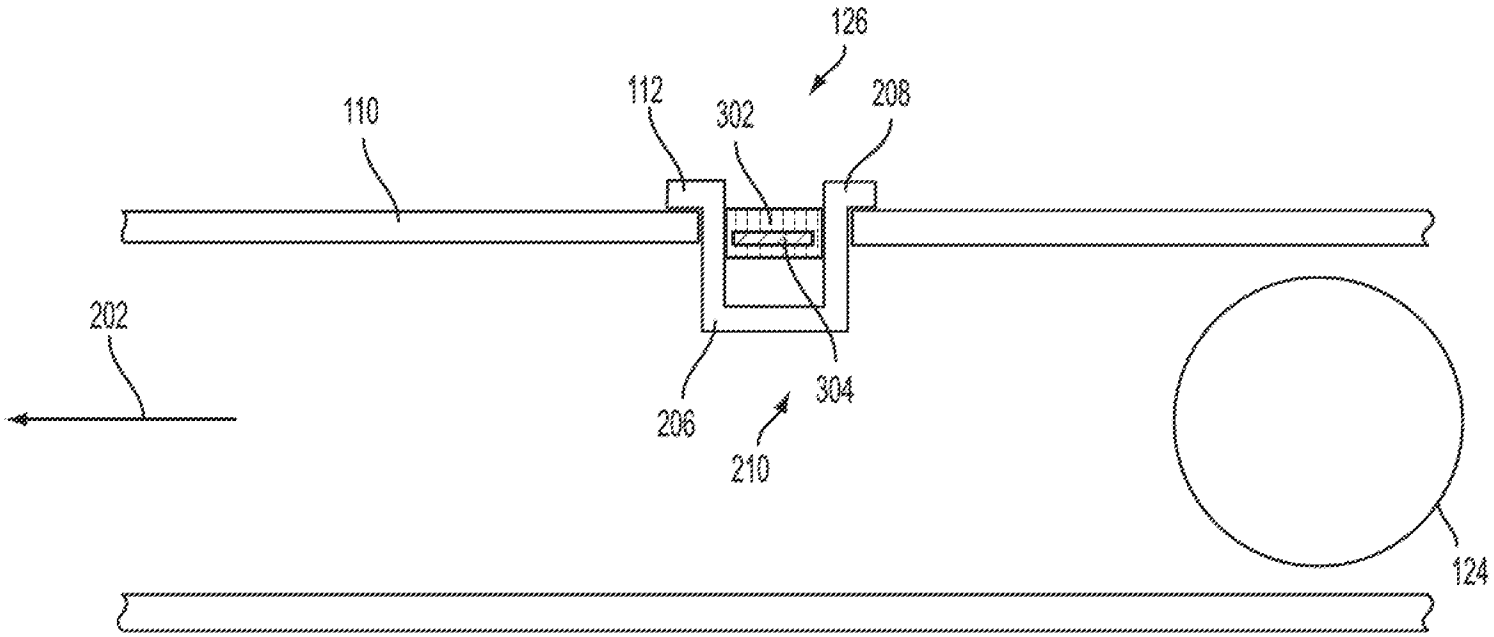
FIG. 3A is a cross-sectional view of part of a tubing string having a plug filled with fusible alloy according to one embodiment of the present disclosure.

FIG. 3A is a cross-sectional view of part of a tubing string 110 having a plug 210 filled with a degradable component 302 according to one embodiment. The degradable component 302 can be made with any degradable material, including dissolvable materials and those other degradable materials described below. The degradable component 302 can be positioned in a plug 210 or a frangible component 112. The degradable component 302 can be placed within the retainable portion 208. In one embodiment, the degradable component 302 is a fusible alloy, which is any material that is solid at a first temperature (e.g., ambient air temperature) and capable of liquefying at or before reaching formation temperature. The first temperature can be an ambient air temperature at the surface of a wellbore or it can be the temperature of injection fluid. As used herein, formation temperature is the temperature of the formation surrounding the tubing string 110 near the degradable component 302. As used here, the term "near formation temperature" includes temperatures that are closer to the formation temperature than to the first temperature.

In another embodiment, the degradable component 302 is a galvanically reacting material that will galvanically react, and therefore degrade, when exposed to the wellbore fluid. In another embodiment, the degradable component 302 is a degradable plastic (e.g., an aliphatic polyester), which will undergo hydrolytic degradation upon exposure to water. Introduction of water to the degradable plastic can be used to degrade the degradable component 302 when desired.

The degradable component 302 can include a magnet 304. Similarly as described above, the magnet 304 can be used to detect whether the degradable component 302 has degraded (e.g., liquefied in the case of a fusible alloy). The magnet 304 can be carried away with the production fluid when the degradable component 302 is sufficiently degraded. A magnetic sensor near the degradable component 302 can detect whether the magnet 304 has been carried away. The magnetic sensor can provide a signal informative of whether the port 126 is open. In an alternative embodiment, a chemical tracer is used instead of the magnet 304 and the chemical tracer is detected by a upstream sensor to determine when the degradable component 302 has sufficiently degraded.

Figure 3B:
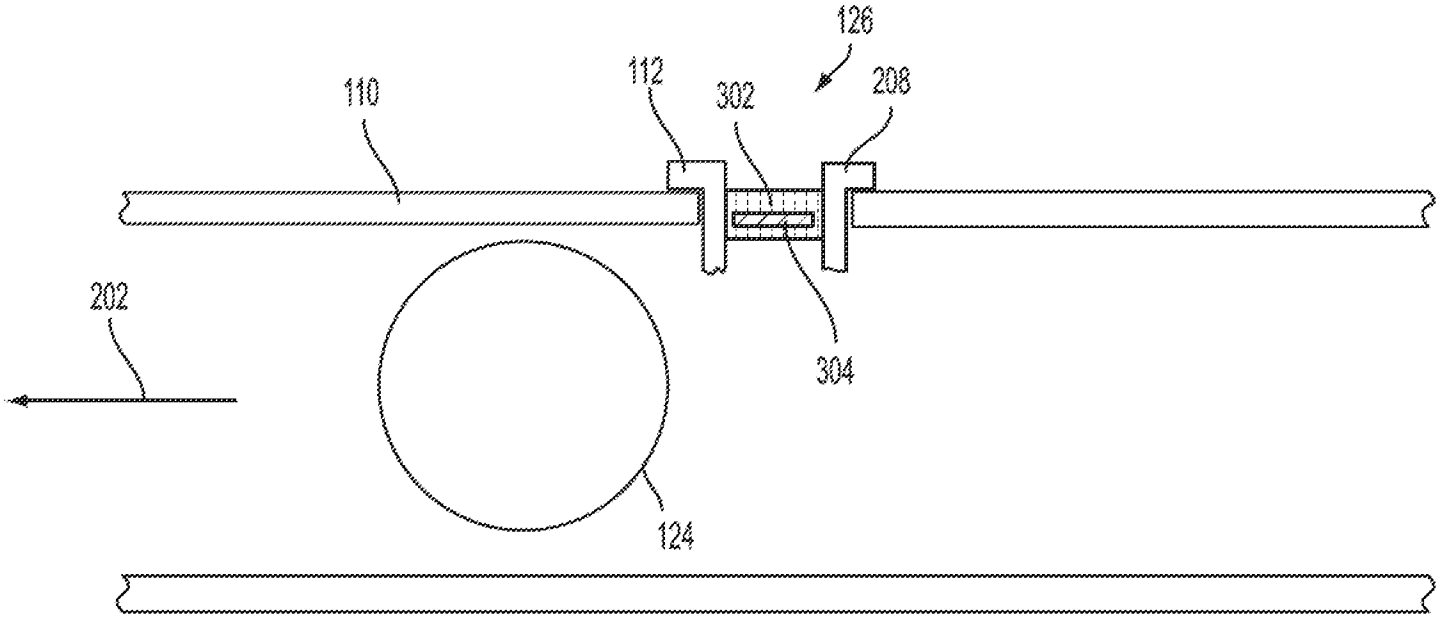
FIG. 3B is a cross-sectional view of part of the tubing string of FIG. 3A in which the frangible component is broken according to one embodiment of the present disclosure.

FIG. 3B is a cross-sectional view of part of the tubing string 110 of FIG. 3A in which the frangible component 112 is broken according to one embodiment. The degradable component 302 is a fusible alloy. The degradable component 302 that is a fusible alloy can be in a solid state within the retainable portion 208 and can occlude the port 126 when the detachable portion 206 is no longer adjoined to the retainable portion 208. In one embodiment, external methods can cool the fusible alloy to keep the fusible alloy in a solid (e.g., non-degraded) state while in a downwell environment. External methods can include circulating a cooling fluid through the tubing string 110 or other devices capable of removing heat from the fusible alloy. In other embodiments, the degradable component 302 that is a fusible alloy can remain in a solid state for a pre-determined amount of time before the formation heats the fusible alloy to the fusible alloy's 302 melting point. The degradable component 302 that is a fusible alloy can remain in a solid state during one or all of a fluid injection stage, formation stimulation, and hydraulic fracturing operation.

Figure 3C:
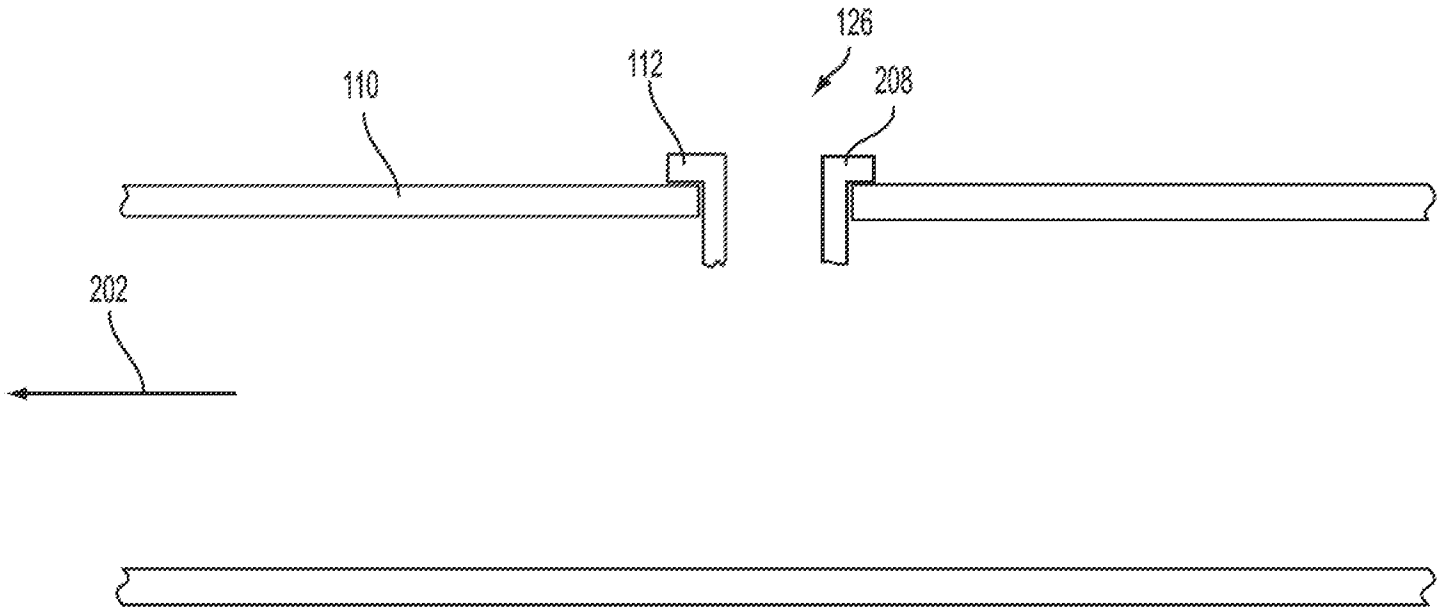
FIG. 3C is a cross-sectional view of part of the tubing string of FIG. 3A in which the frangible component is broken and the fusible alloy is liquefied according to one embodiment of the present disclosure.

FIG. 3C is a cross-sectional view of part of the tubing string 110 of FIG. 3A with a broken frangible component 112 and degraded degradable component 302 according to one embodiment. The degradable component 302, being sufficiently degraded, is no longer located in the retainable portion 208 and the port 126 is open for fluid transfer.

In some embodiments, plugs 210 or frangible components 112 with degradable component 302 can be located near the heel 118 of the wellbore 114, and plugs 210 or frangible components 112 without degradable component 302 can be located near the toe 120 of the wellbore 114. The ports 126 near the toe 120 of the wellbore 114 can be opened first by releasing an object 124. The object 124 propelled towards the surface 116 can break the frangible components 112 near the heel 118 of the wellbore 114 and toe 120 of the wellbore 114. The degradable component 302 near the heel 118 can occlude the ports 126 near the heel 118 of the wellbore 114 while ports 126 near the toe 120 of the wellbore 114, which do not have degradable component 302, can be open to fluid transfer. Subsequently, the degradable component 302 can be allowed to degrade after being exposed to the wellbore condition (e.g., warm to formation temperature when a fusible alloy is used). Degradation of the degradable component 302 can open the ports 126 near the heel 118 of the wellbore 114. The ports 126 near the heel 118 of the wellbore 114 can be opened at a desired time after the ports 126 near the toe 120 of the wellbore 114.

In alternate embodiments, a first type of degradable component 302 can be used in ports 126 near the heel 118 and a second type of degradable component 302 can be used in ports 126 near the toe 120. The degradable components 302 can be selected to degrade at different rates, allowing the ports 126 near the heel 118 and ports 126 near the toe 120 to open at different times. For example, the first type of degradable component 302 can degrade substantially slower than the second type of degradable component 302, allowing the ports 126 near the toe 120 to open substantially earlier than the ports 126 near the heel 118.

In some embodiments, a degradable component 302 that is a fusible alloy is cooled by external cooling methods, as described above. The external cooling methods can be selectively disabled to allow certain degradable components 302 that are fusible alloys to warm and liquefy while other degradable components 302 that are fusible alloys remain cool.

Figure 4A:
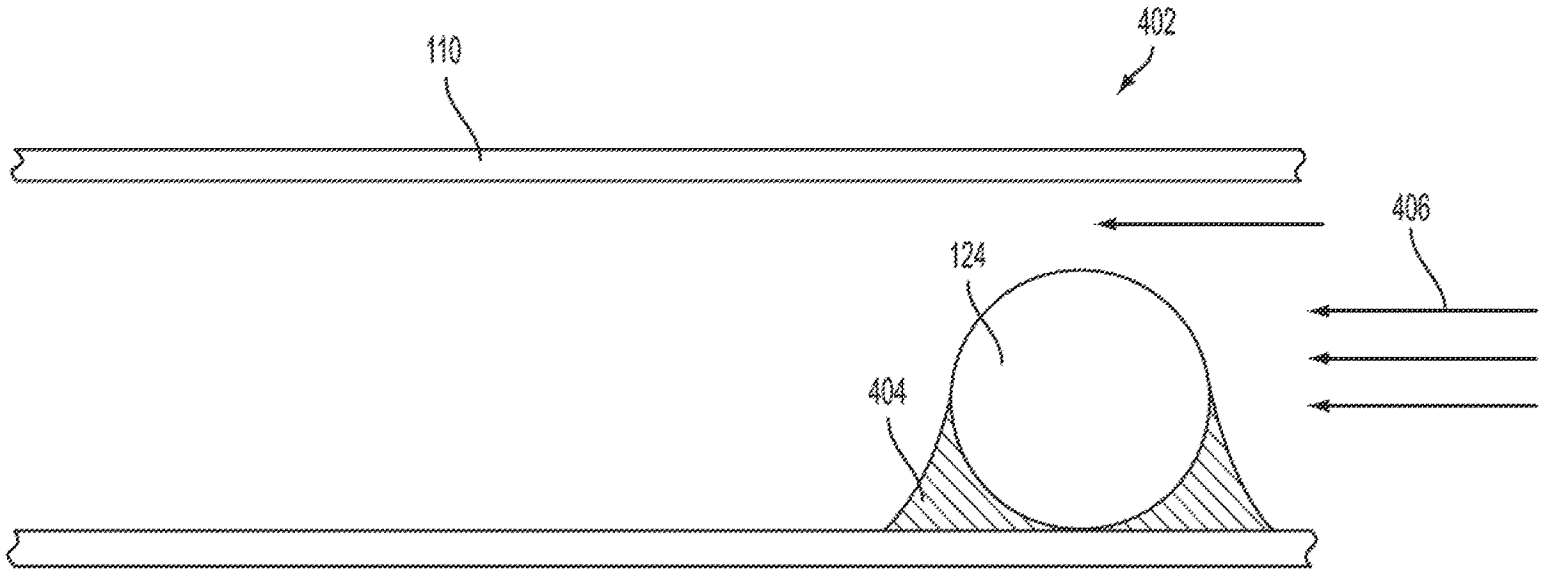
FIG. 4A is a cross-sectional view of part of a tubing string having a release section with an object retained by a degradable material according to one embodiment of the present disclosure.

FIG. 4A is a cross-sectional view of part of a tubing string 110 having a release section 402 with an object 124 held in place by a degradable material 404 according to one embodiment. The object 124 can be partially or fully enclosed in the degradable material 404. The degradable material 404 can retain the object 124 while production fluid 406 is able to flow within the tubing string 110. The degradable material 404 can degrade over time. The time of release of the object 124 can be estimated based on the rate of degradation of the degradable material 404.

Examples of degradable materials 404 can include galvanically corrodible materials (e.g., graphite, aluminum, magnesium, or anything with a strong galvanic potential), degradable plastics (e.g., polylactic acid (PLA), PGA, aliphatic polyesters), dissolvable materials (e.g., salt, sugar, or borate glass), or other materials degradable in production fluid (e.g., natural rubber or ethylene propylene diene monomer (EPDM) rubber). As used herein, the term "degradable" is indicative of a material or component that loses strength, whereas the term "dissolvable" is indicative of a material or component that completely degrades (i.e., disappears). A degradable material or component need not dissolve. Examples of dissolvable metals include a powder metal compact, a sintered combination of dissolving powders, and a plurality of encased particles sintered together where the encased particles control the degradation rate. Other dissolvable materials can be used.

Figure 4B:
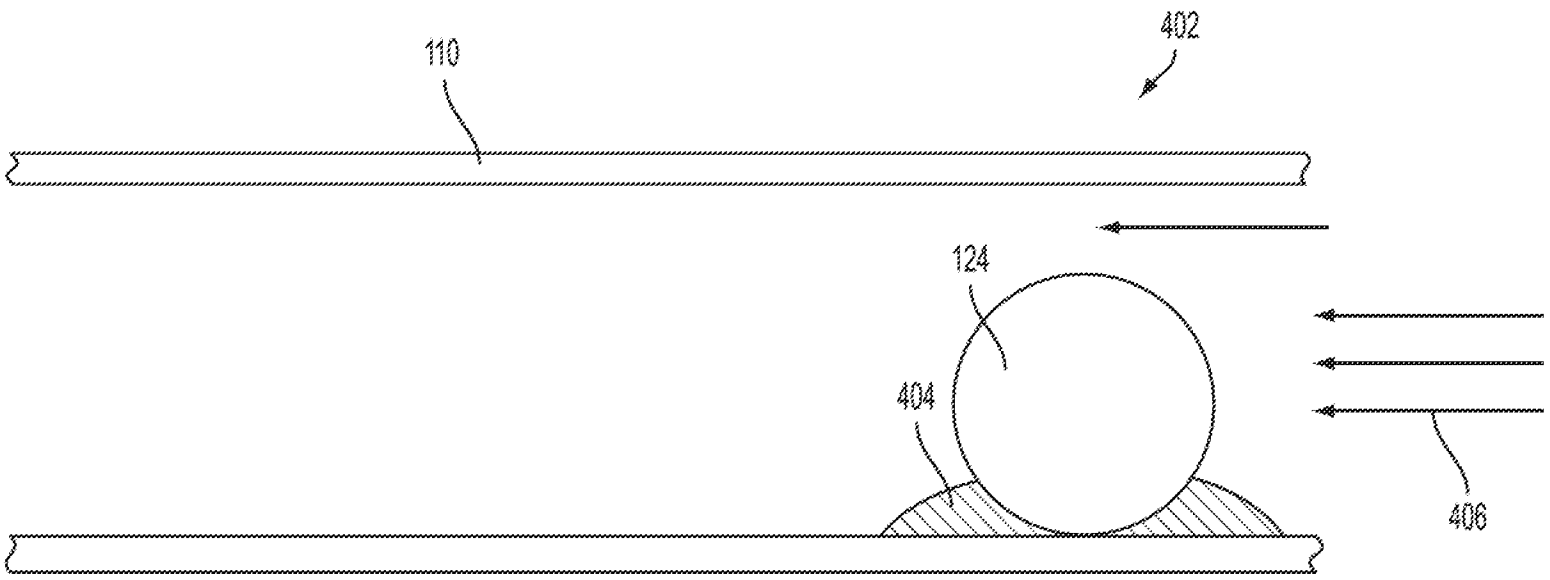
FIG. 4B is a cross-sectional view of part of the tubing string of FIG. 4A in which the degradable material is partially degraded according to one embodiment of the present disclosure.

FIG. 4B is a cross-sectional view of part of the tubing string 110 of FIG. 4A in which the degradable material 404 is partially degraded according to one embodiment.

Figure 4C:
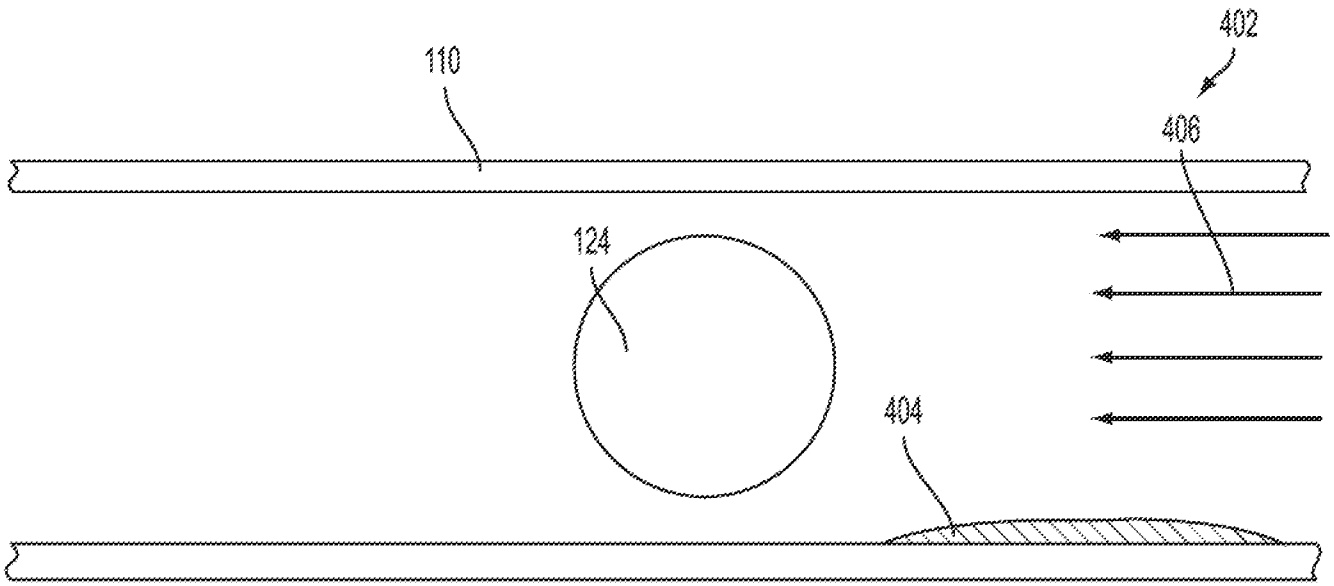
FIG. 4C is a cross-sectional view of part of the tubing string of FIG. 4A in which the degradable material is degraded sufficiently to release the object according to one embodiment of the present disclosure.

FIG. 4C is a cross-sectional view of part of the tubing string 110 of FIG. 4A in which the degradable material 404 is degraded sufficiently to release the object 124 according to one embodiment.

In alternate embodiments, the degradable material 404 can be used to retain a mechanical blockade in place, such as a gate, which itself retains the object 124. When the degradable material 404 has degraded sufficiently, the mechanical blockade can move enough to release the object 124.

Figure 5A:
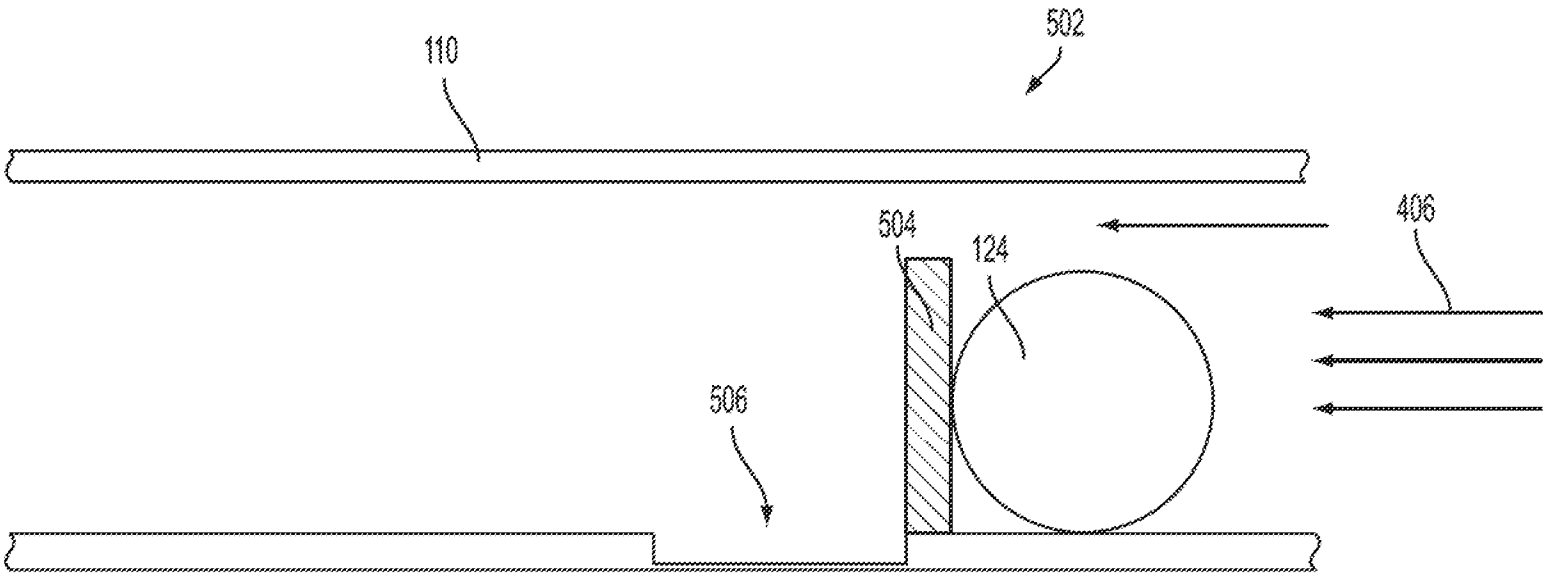
FIG. 5A is a cross-sectional view of part of a tubing string having a release section with an object held in place by a gate according to one embodiment of the present disclosure.

FIG. 5A is a cross-sectional view of part of a tubing string 110 having a release section 502 with an object 124 held in place by a gate 504 according to one embodiment. A gate 504 can retain the object 124 in a tubing string 110 until triggered. When triggered, the gate 504 can release the object 124. The released object 124 can travel up the wellbore 114 towards the surface 116. The released object 124 can be carried towards the surface 116 by the production fluid 406. The gate 504 can be triggered electronically, hydraulically, pneumatically, or by other methods. As used herein, the term "gate" includes other mechanical blockades, such as latches, irises, or other mechanical objects that retain the object until triggered. The signal to trigger the gate 504 can be a wirelessly conveyed signal or it can be a command calculated based on time, temperature, or other downhole conditions.

Figure 5B:
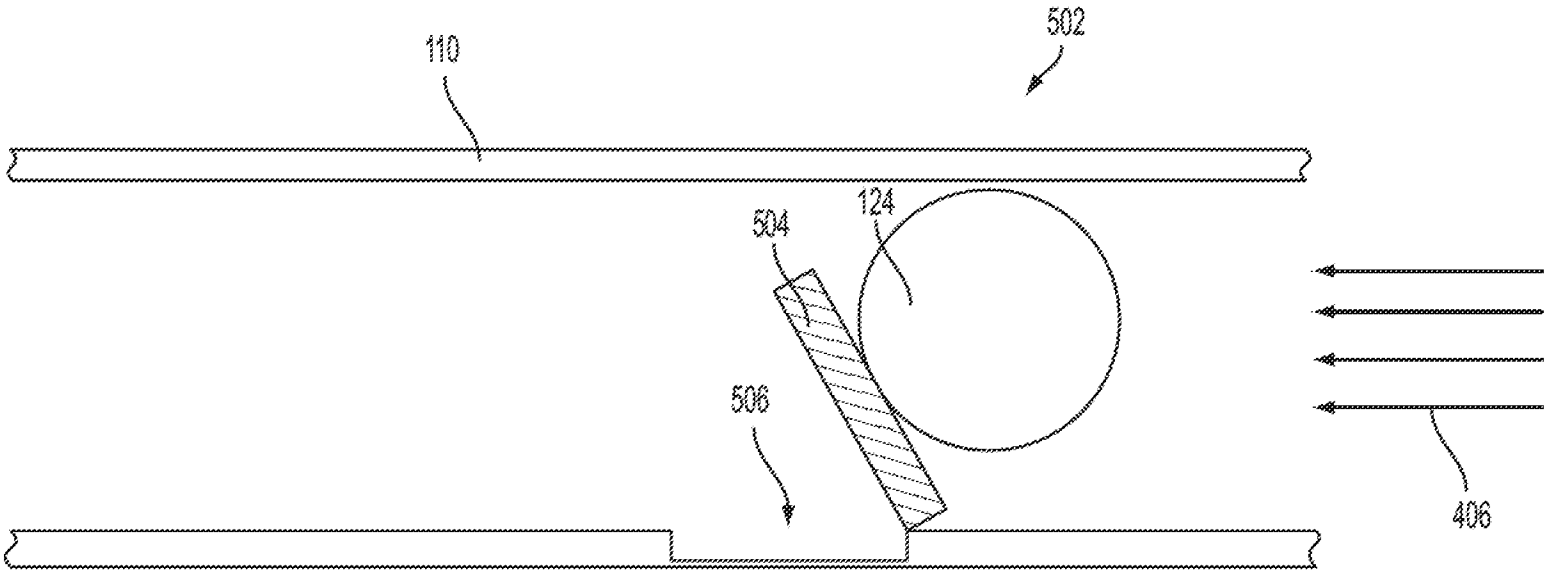
FIG. 5B is a cross-sectional view of part of the tubing string of FIG. 5A in which the gate is partially open according to one embodiment of the present disclosure.

FIG. 5B is a cross-sectional view of part of the tubing string 110 of FIG. 5A. The triggered gate 504 is partially opened. The object 124 is being pushed towards the surface 116 by the production fluid 406.

Figure 5C:
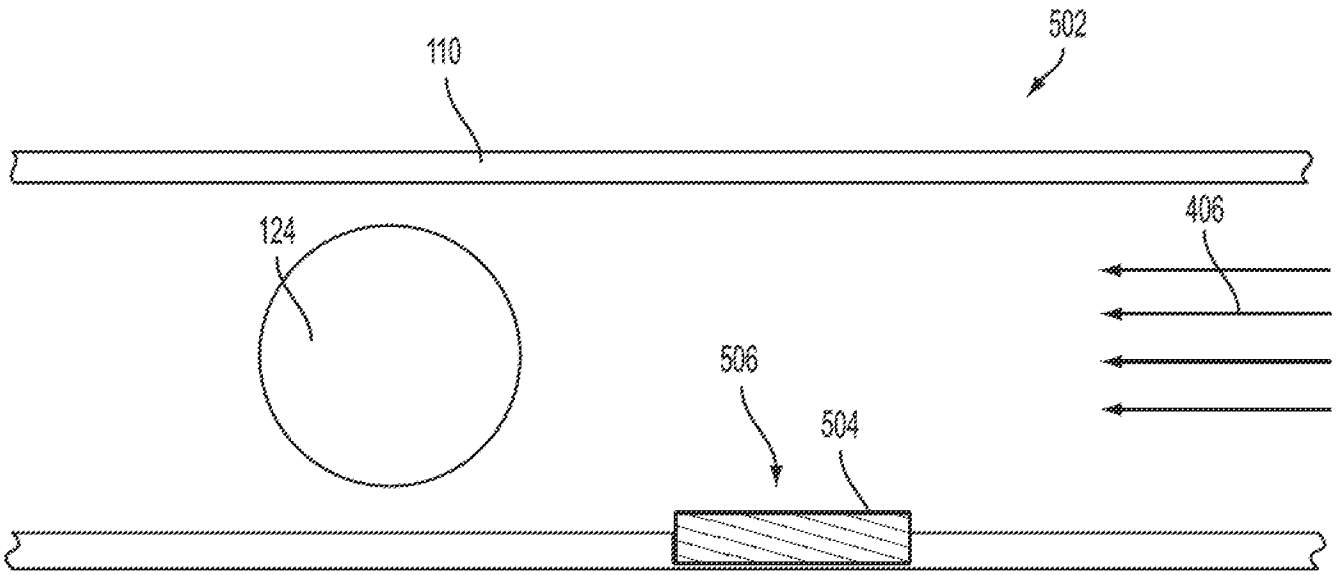
FIG. 5C is a cross-sectional view of part of the tubing string of FIG. 5A in which the gate is opened sufficiently to release the object according to one embodiment of the present disclosure.

FIG. 5C is a cross-sectional view of part of the tubing string of FIG. 5A in which the gate 504 is opened sufficiently to release the object 124. The gate 504 can move into a gate recess 506.

Figure 6A:
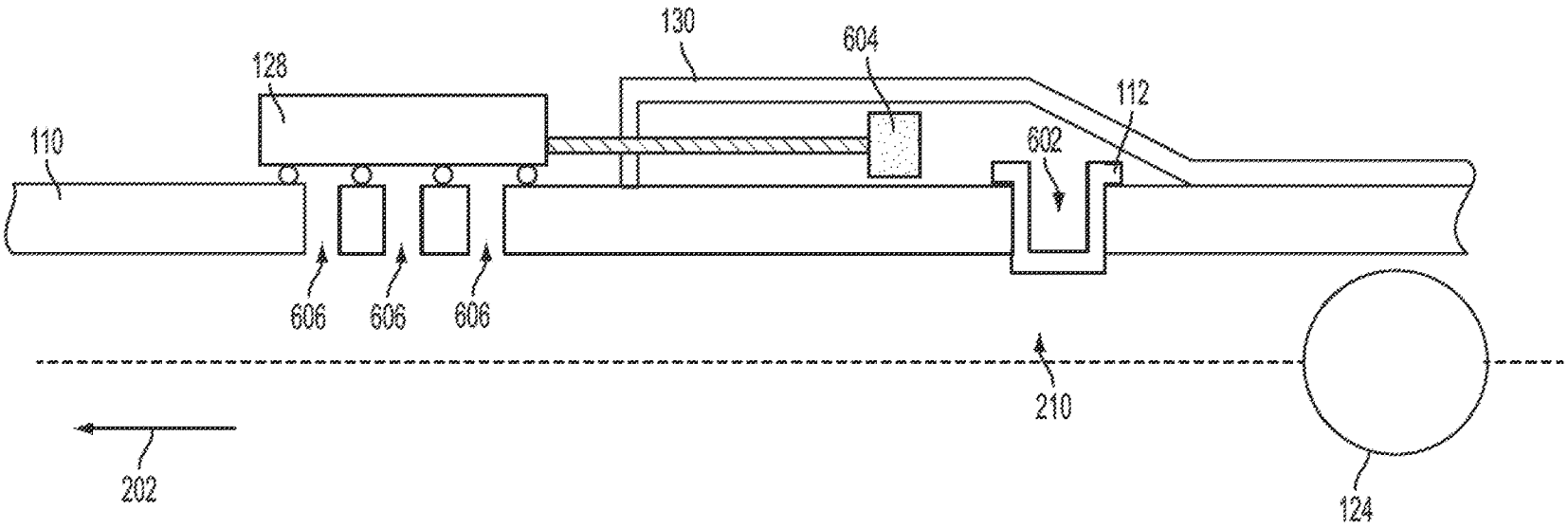
FIG. 6A is a cross-sectional view of part of a tubing string having a sleeve covering and sealing additional ports according to one embodiment of the present disclosure.

FIG. 6A is a cross-sectional view of part of a tubing string 110 having a sleeve 128 covering and sealing additional ports 606 according to one embodiment. The sleeve 128 is associated with a frangible component 112. The sleeve 128 can move in response to breaking of a frangible component 112. The plug 210 or frangible component 112 can occlude a first port 602. A sleeve 128 can be positioned to cover additional ports 606. Gaskets or other sealing devices can be used to ensure the sleeve 128 sufficiently seals the additional ports 606. The sleeve 128 can move between a closed position, where the additional ports 606 are sealed, to an open position, where the additional ports 606 are open to fluid flow. The object 124 can travel in the direction 202 towards the surface 116 of the wellbore 114 and the object 124 can strike and break the frangible component 112. When the frangible component 112 is broken, a first port 602 can allow fluid to flow into the piston chamber 130. Inside the piston chamber 130, a piston 604 can be coupled to the sleeve 128.

Figure 6B:
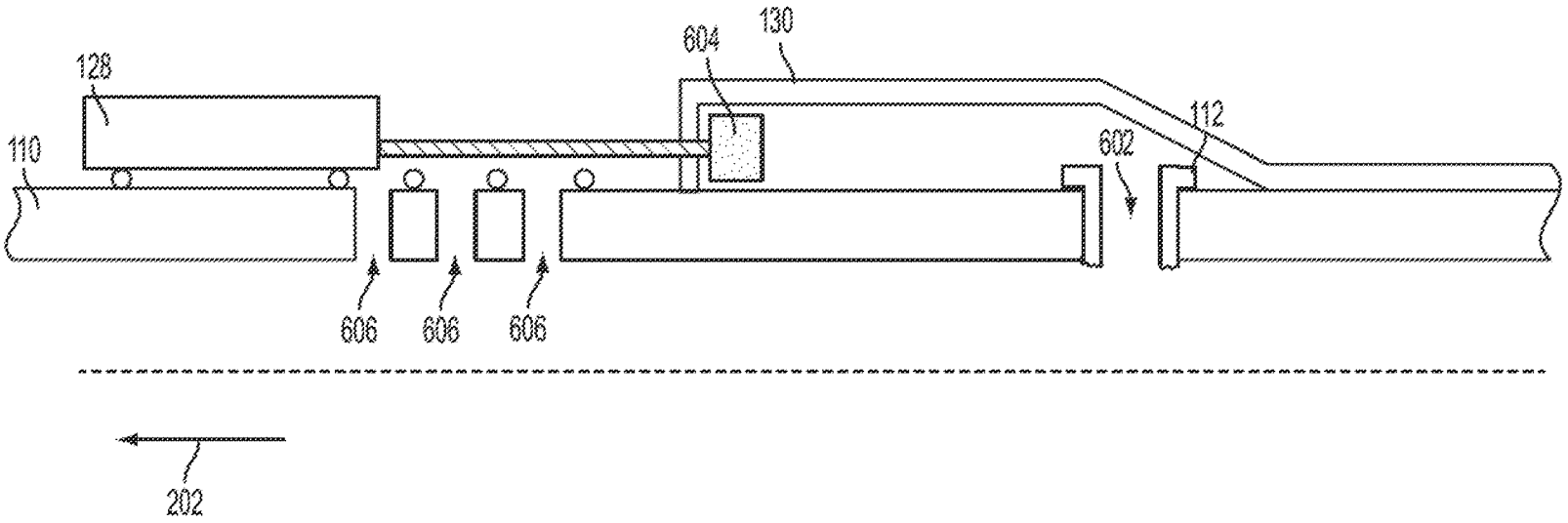
FIG. 6B is a cross-sectional view of part of the tubing string of FIG. 6A in which the sleeve is not covering and sealing the additional ports and the frangible component is broken according to one embodiment of the present disclosure.

FIG. 6B is a cross-sectional view of part of the tubing string 110 of FIG. 6A in which the sleeve 128 is not covering and sealing the additional ports and the frangible component 112 is broken according to one embodiment. When the frangible component 112 is broken, fluid is allowed to pass through the first port 602. Fluid passing through first port 602 can enter the piston chamber 130, forcing the piston 604 to move. Movement of the piston 604 can cause the sleeve 128 to move. Movement of the sleeve 128 can uncover the additional ports 606. A single frangible component 112 or a small number of frangible components 112 can cause a large number of additional ports 606 to be opened using one or more sleeves 128.

In another embodiment, the sleeve 128 can be positioned to not cover the additional ports 606 when the frangible component 112 is not broken. When the frangible component 112 is broken, a first port 602 can open, fluid flowing through the first port 602 can cause the piston 604 to move, and movement of the piston 604 can cause the sleeve 128 to cover the additional ports 606. A single frangible component 112 or a small number of frangible components 112 can cause a large number of additional ports 606 to be sealed using one or more sleeves 128.

In other embodiments, a piston 604 can be coupled to tools other than sleeves 128. Breaking of a frangible component 112 can cause movement of the piston 604, which can cause actuation of a tool.

Figure 7A:
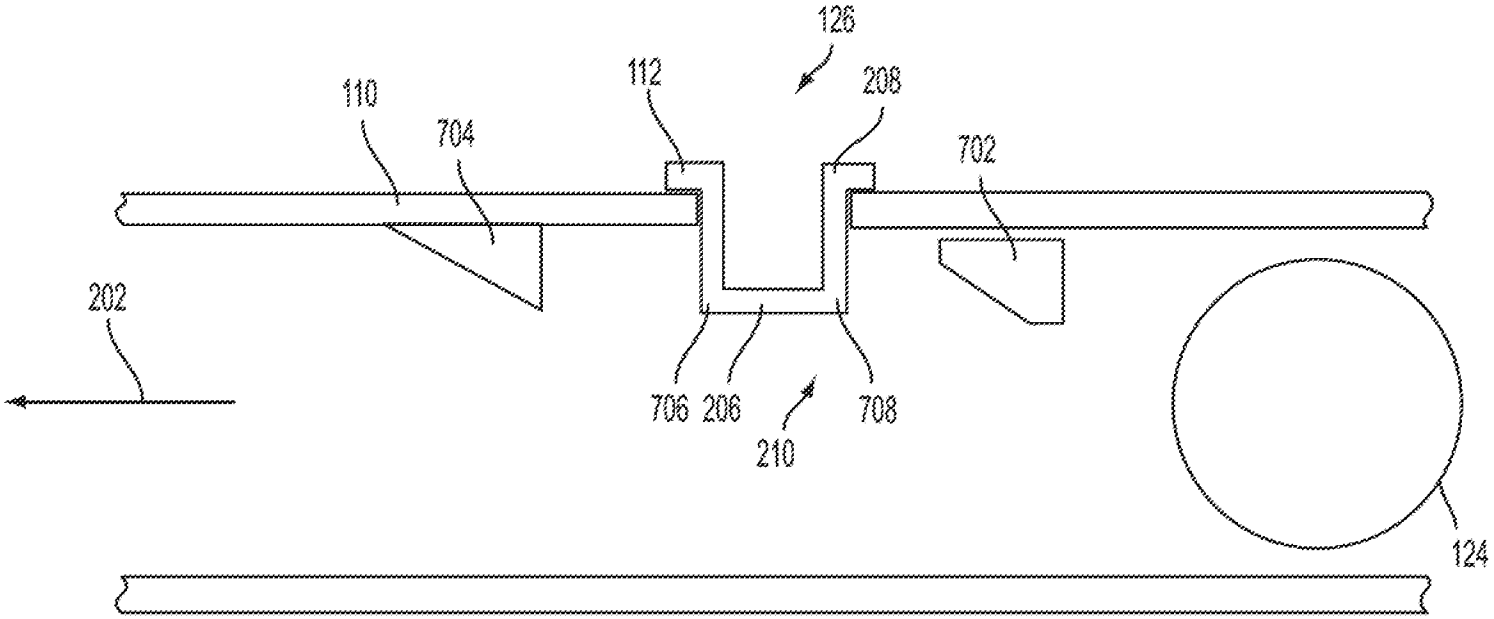
FIG. 7A is a cross-sectional view of part of a tubing string having a frangible component and a sliding hammer according to one embodiment of the present disclosure.

FIG. 7A is a cross-sectional view of part of a tubing string 110 having a frangible component 112 and a sliding hammer 702 according to one embodiment. In such embodiments, the object 124 can impact a sliding hammer 702. The sliding hammer 702 can impact the plug 210 or frangible component 112 upon impact by the object 124. The frangible component 112 can break or sheer upon impact from the sliding hammer 702. The sliding hammer 702 can be of various shapes and sizes. The area of impact between the plug 210 or frangible component 112 and the sliding hammer 702 can be large (e.g., a large block), small (e.g., a blade-like edge), or any other applicable size.

Figure 7B:
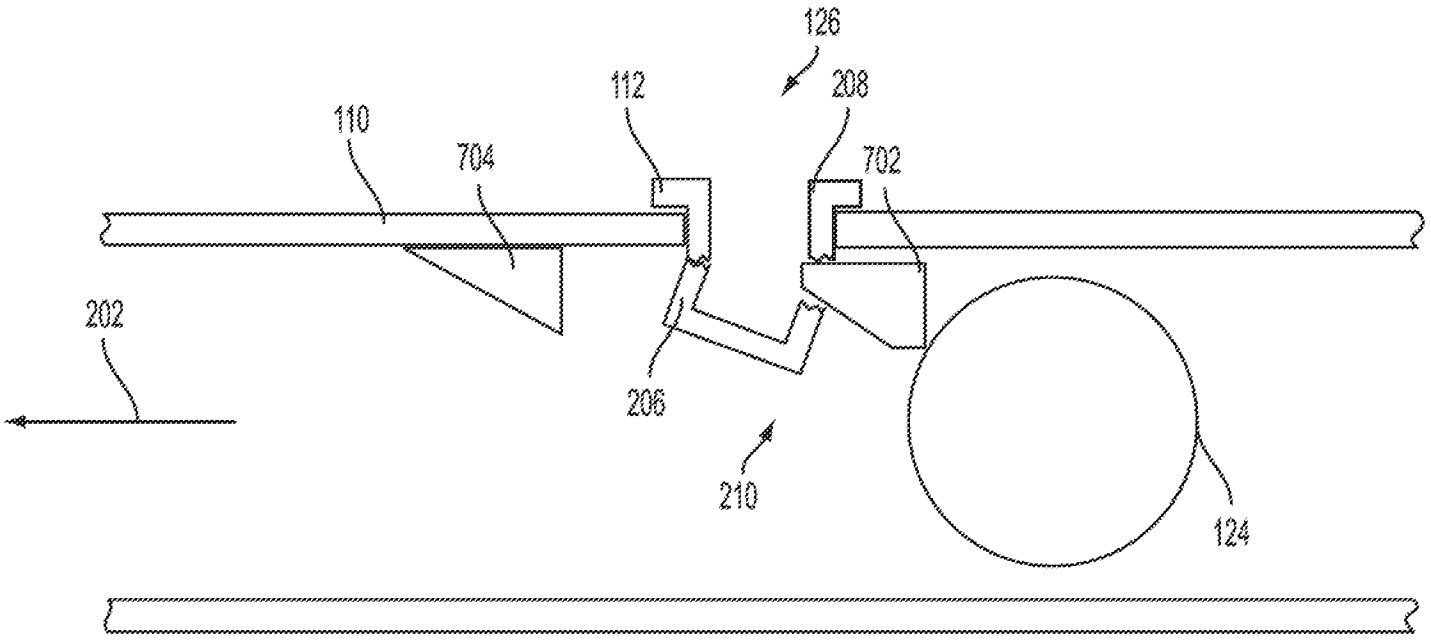
FIG. 7B is a cross-sectional view of part of the tubing string of FIG. 7A in which the frangible component is partially broken by the sliding hammer according to one embodiment of the present disclosure.

FIG. 7B is a cross-sectional view of part of the tubing string 110 of FIG. 7A in which the frangible component 112 is partially broken by the sliding hammer 702 according to one embodiment. The object 124 can push the sliding hammer 702 into the frangible component 112. The sliding hammer 702 can break or sheer the frangible component 112.

Figure 7C:
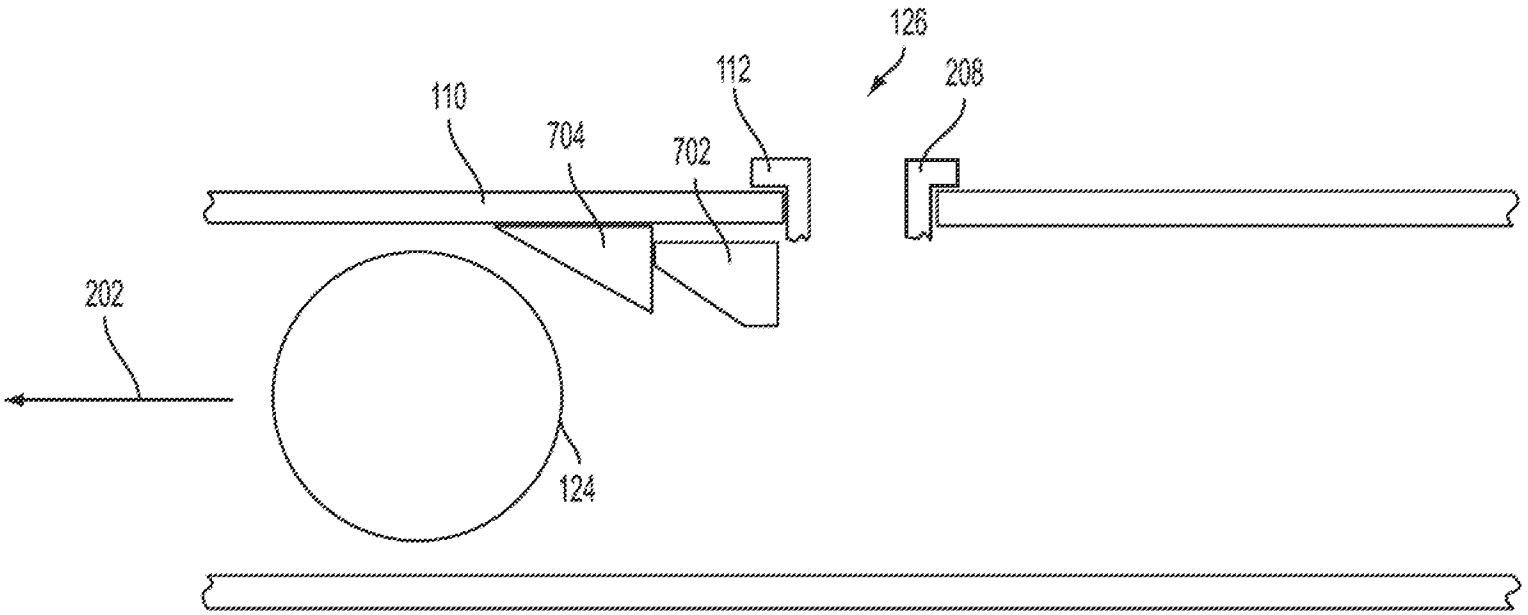
FIG. 7C is a cross-sectional view of part of the tubing string of FIG. 7A in which the frangible component is fully broken by the sliding hammer according to one embodiment of the present disclosure.

FIG. 7C is a cross-sectional view of part of the tubing string 110 of FIG. 7A in which the frangible component 112 is fully broken by a sliding hammer 702 according to one embodiment.

The tubing string 110 can include a block 704 arranged to protect the plug 210 or frangible component 112 from impact in a direction other than the direction 202 from the bottom of the wellbore 114 towards the surface 116. Block 704 can protect the frangible component 112 from breakage in directions other than from the toe 120 to the surface 116. The block 704 can protect the frangible component 112 from being broken by tools placed into or used in the tubing string 110. Block 704 as described herein can be used with any of the previously disclosed embodiments or other embodiments.

In some embodiments, the frangible component 112 can be directionally strengthened. Directional strengthening can include preparing the plug 210 or frangible component 112 so that the frangible component 112 is less likely to break when the plug 210 or frangible component 112 is impacted from a direction other than the direction 202 from the bottom of the wellbore 114 towards the surface 116. Directional strengthening can be accomplished by thinning one side of the frangible component 112, by placing one or more notches in one side of the frangible component 112, by placing an extra support near one side of the plug 210 or frangible component 112, by reinforcing a portion of the frangible component 112 with fiber, by placing impact resistant coating (e.g., rubber) on one side of the plug 210 or frangible component 112, or by other methods of strengthening or protecting the plug 210 or frangible component 112.

The frangible component 112 can have a toe side 708 and a surface side 706. The toe side 708 of the frangible component 112 is the side located deeper along the wellbore 114 than the surface side 706. The frangible component 112 can be directionally strengthened by having a surface side 706 with an average thickness greater than the average thickness of the toe side 708.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is an assembly including a tubing string in a wellbore. The tubing string includes an opening through a wall of the tubing string and a frangible component occluding the opening. The assembly includes an object operable to break the frangible component while moving towards a surface of the wellbore.

Example 2 is an assembly of example 1, additionally including a release section operable to release the object.

Example 3 is an assembly of example 2, wherein the release section includes a gate operable to release the object.

Example 4 is an assembly of example 2, wherein the object is retained in the release section by a material degradable in the wellbore.

Example 5 is an assembly of examples 1-4, wherein the object is propelled towards the surface by production fluid.

Example 6 is an assembly of examples 1-5, additionally including a fusible alloy operable to occlude the opening when solid, wherein the fusible alloy is liquid at or near formation temperature.

Example 7 is an assembly of examples 1-6, wherein the frangible component is directionally strengthened.

Example 8 is an assembly of examples 1-7, wherein the object impacts a hammer that breaks the frangible component.

Example 9 is an assembly of examples 1-8, wherein the frangible component includes a magnet.

Example 10 is an assembly of examples 1-9, additionally including a sleeve operable to slide in response to the frangible component breaking.

Example 11 is an assembly of example 10, wherein the sleeve is operable to cover a port in response to the frangible component breaking.

Example 12 is a method including releasing an object from a tubing string in a wellbore, moving the object through the tubing string towards a surface of the wellbore, and breaking a frangible component covering an opening in response to moving the object.

Example 13 is a method of example 12, wherein moving the object includes allowing production fluid to propel the object through the tubing string towards the surface.

Example 14 is a method of examples 12 or 13, additionally including cooling a fusible alloy positioned in the opening, wherein the fusible alloy is operable to occlude the opening when the frangible component is broken.

Example 15 is a method of examples 12-14, additionally including sliding a sleeve to uncover at least one port in response to breaking the frangible component.

Example 16 is a method of examples 12-15, additionally including providing a signal in response to breaking the frangible component.

Example 17 is a wellbore system including a first frangible component occluding a first port in a tubing string in a wellbore. The system also includes a second frangible component occluding a second port in the tubing string. The system further includes an object releasable from a release section of the tubing string, wherein the release section is positioned further from a surface of the wellbore than both the first frangible component and the second frangible component. The object is operable to break the first frangible component and the second frangible component while being propelled by production fluid towards the surface of the wellbore.

Example 18 is a wellbore system of example 17, additionally including a fusible alloy operable to occlude the first port when the first frangible component is broken and further operable to liquefy at formation temperature to open the first port.

Example 19 is a wellbore system of examples 17 or 18, additionally including a set of additional ports coverable by a sleeve and a piston operable to move the sleeve in response to fluid passing through the first port.

Example 20 is a wellbore system of examples 17-19, wherein the release section includes a degradable material operable to release the object after a predetermined amount of time within the wellbore.

Example 21 is a system including an object positionable in a tubing string. The tubing string is positionable in a wellbore. The object is releasable to travel towards a surface of the wellbore to break a frangible component.

Example 22 is a system of example 21, including a gate operable to release the object.

Example 23 is a system of examples 21 or 22, including a degradable material operable to retain the object. The degradable material is further operable to release the object after a pre-determined amount of time.

Example 24 is a system of examples 21-23, including a hammer positionable near the frangible component and operable to break the frangible component in response to impact by the object (e.g., the object impacting the hammer).

Example 25 is a system of examples 21-24, including a magnet positioned in the wellbore and releasable to travel towards the surface in response to breakage of the frangible component.

Example 26 is a system of examples 21-25 where the object is made from a degradable polymer, a eutectic alloy, a galvanic composition, aluminum, salt, or compressed wood.

Example 27 is a system of examples 21-26, including a block positioned to protect the frangible component from breakage in directions other than from a toe of the wellbore towards the surface of the wellbore.

Example 28 is a system of examples 21-27 where the frangible component is operable to resist breakage from directions other than from a toe of the wellbore towards the surface of the wellbore.

Example 29 is a system of example 28, where the frangible component has a surface side and a toe side. The toe side is positioned deeper into the wellbore than the surface side. The toe side has an first average thickness less than a second average thickness of the surface side.

Example 30 is a system of examples 21-29, including a plug positionable in a port of the tubing string to block fluid flow through the port. The plug includes a detachable portion. The detachable portion is separable from the plug in response to breakage of the frangible component. The plug is operable to allow fluid flow through the port in response to separation of the detachable portion.

Example 31 is a system of example 30, including fusible alloy positionable in the plug. The fusible alloy is operable to block fluid flow through the port when solid. The fusible alloy is liquid at or near formation temperature.

Example 32 is a system of examples 30 or 31, including a sleeve operable to move between a closed position blocking fluid flow through an additional port and an open position allowing fluid flow through the additional port. The system further includes a piston chamber including a piston. The port is positioned between an inner diameter of the tubing string and the piston chamber. The piston chamber is operable to move the sleeve in response to fluid flow through the port.

Example 33 is a method, including releasing an object from a tubing string in a wellbore, moving the object through the tubing string towards a surface of the wellbore, and breaking a frangible component in response to moving the object.

Example 34 is a method of example 33, including moving a sleeve in response to breaking the frangible component. The sleeve is operable to move between a closed position sealing an additional port and an open position allowing fluid flow through the additional port.

Example 35 is a method of examples 33 or 34, including providing a signal in response to breaking the frangible component.

Example 36 is a method of examples 33-35, where the tubing string includes a port. The port includes a plug operable to block fluid flow through the port. The method also includes separating a detachable portion from the plug in response to breaking the frangible component. Separating the detachable portion allows fluid flow through the port.

Example 37 is a method of examples 33-36, including cooling a fusible alloy positioned in the port to a temperature below the melting point of the fusible alloy. The fusible alloy is operable to block fluid flow through the port when the fusible alloy is solid.

Example 38 is a port-opening system in a tubing string, including a tubing string in a wellbore, the tubing string having a port for fluid flow. A frangible plug is positioned to block fluid flow through the port. An object is releasable from a release section of the tubing string. The release section is positioned further from a surface of the wellbore than the port. The object is operable to break the frangible plug while being propelled by production fluid towards the surface of the wellbore. The frangible plug is operable to allow fluid flow through the port when broken.

Example 39 is a system of example 38, including a degradable component positionable in the frangible plug. The degradable component is operable to prevent fluid flow through the port when the frangible plug is broken. The degradable component degrades in the wellbore environment. The degradable component allows fluid flow through the port when degraded.

Example 40 is a system of example 38 or 39, including a sleeve movable between a closed position blocking fluid flow through a set of additional ports, and an open position allowing fluid flow through the set of additional ports. The system also includes a piston connected to the sleeve and operable to move the sleeve in response to fluid flow through the first port.

What is claimed is:

1. A port-opening system, comprising:

a tubing string, the tubing string having a port for fluid flow;

a frangible plug positioned to block fluid flow through the port; and a ball, wiper, or free-flowing plug releasable from a release section of the tubing string, the release section positionable further from a surface of a wellbore than the port; wherein:

the ball, wiper, or free-flowing plug is operable to break the frangible plug while being propelled by production fluid towards the surface of the wellbore; and the frangible plug is operable to allow fluid flow through the port when broken.

2. The system of claim 1, additionally comprising:

a degradable component positionable in the frangible plug and operable to:

prevent fluid flow through the port when the frangible plug is broken;

degrade in a wellbore environment; and allow fluid flow through the port when degraded.

3. The system of claim 1, additionally comprising:

a sleeve movable between a closed position blocking fluid flow through a set of additional ports, and an open position allowing fluid flow through the set of additional ports; and a piston connected to the sleeve and operable to move the sleeve in response to fluid flow through the port.

4. A system, comprising:

a tubing string positionable in a wellbore; and a ball, wiper, or free-flowing plug positioned in the tubing string, wherein the ball, wiper, or free-flowing plug is releasable to travel towards a surface of the wellbore to break a frangible component.

5. The system of claim 4, additionally comprising:

a gate positioned in the tubing string at a location spaced apart from the frangible component;

wherein the gate retains the ball, wiper, or free-flowing plug and is operable to release the ball, wiper, or free-flowing plug.

6. The system of claim 4, additionally comprising:

a degradable material positioned in the tubing string at a location spaced apart from the frangible component;

wherein the degradable material retains the ball, wiper, or free-flowing plug and is operable to release the ball, wiper, or free-flowing plug after a pre-determined amount of time.

7. The system of claim 4, additionally comprising:

a hammer positioned adjacent the frangible component and operable to break the frangible component in response to impact by the ball, wiper, or free-flowing plug.

8. The system of claim 4, additionally comprising:

a magnet coupled to the frangible component and releasable to travel towards the surface in response to breakage of the frangible component.

9. The system of claim 4, wherein the ball, wiper, or free-flowing plug is made from a material selected from the group consisting of a degradable polymer, a eutectic alloy, a galvanic composition, aluminum, salt, and compressed wood.

10. The system of claim 4, additionally comprising a block positioned adjacent the frangible component to protect the frangible component from breakage in directions other than from a toe of the wellbore towards the surface of the wellbore.

11. The system of claim 4, wherein:

the frangible component is a plug positioned in a port in the tubing string;

the frangible component blocks fluid flow through the port; and the ball, wiper, or free-flowing plug is releasable at or near a toe of the wellbore.

12. The system of claim 4, wherein:

the frangible component has a surface side and a toe side; and the toe side is positionable deeper into the wellbore than the surface side.

13. The system of claim 4, wherein:

the frangible component is a plug positionable in a port of the tubing string to block fluid flow through the port, the plug including a detachable portion;

the detachable portion is separable from the plug in response to breakage of the frangible component; and the plug is operable to allow fluid flow through the port in response to separation of the detachable portion.

14. The system of claim 13, wherein:

the plug includes a retainable portion having an opening to allow fluid flow through the port when the detachable portion is separated from the plug;

a degradable component in a non-degraded state is positioned in the retainable portion and occludes the opening of the retainable portion; and the degradable component degrades in a wellbore environment to allow fluid flow through the opening of the retainable portion.

15. The system of claim 13, additionally comprising:

a movable sleeve having a closed position blocking fluid flow through an additional port and an open position allowing fluid flow through the additional port; and a piston chamber including a piston;

wherein:

the port is positioned between an inner diameter of the tubing string and the piston chamber; and the piston chamber is operable to move the sleeve in response to fluid flow through the port.

16. A method, comprising:

releasing a ball, wiper, or free-flowing plug from a tubing string in a wellbore;

moving the ball, wiper, or free-flowing plug through the tubing string towards a surface of the wellbore; and breaking a frangible component in response to moving the ball, wiper, or free-flowing plug.

17. The method of claim 16, additionally comprising:

moving a sleeve in response to breaking the frangible component, wherein the sleeve is operable to move between a closed position sealing an additional port and an open position allowing fluid flow through the additional port.

18. The method of claim 16, additionally comprising:

providing a signal in response to breaking the frangible component.

19. The method of claim 16, wherein the tubing string includes a port and the frangible component is a plug operable to block fluid flow through the port, the method additionally comprising:

separating a detachable portion from the plug in response to breaking the frangible component, wherein separating the detachable portion allows fluid flow through the port.

20. The method of claim 19, additionally comprising:

cooling a fusible alloy positioned in the port to a temperature below a melting point of the fusible alloy, wherein the fusible alloy is operable to block fluid flow through the port when the fusible alloy is solid.

* * * * *